US008904818B2

(12) United States Patent
Tsuboi

(10) Patent No.: US 8,904,818 B2
(45) Date of Patent: Dec. 9, 2014

(54) REFRIGERATOR

(75) Inventor: Noboru Tsuboi, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 365 days.

(21) Appl. No.: 13/238,072

(22) Filed: Sep. 21, 2011

(65) Prior Publication Data

US 2012/0090349 A1 Apr. 19, 2012

(30) Foreign Application Priority Data

Oct. 13, 2010 (JP) ..... 2010-230773

(51) Int. Cl.

| | |
|---|---|
| ***F25B 1/00*** | (2006.01) |
| ***F25B 27/00*** | (2006.01) |
| ***F01D 15/00*** | (2006.01) |
| ***F25B 1/047*** | (2006.01) |
| ***F01K 25/08*** | (2006.01) |

(52) U.S. Cl.

CPC ..... *F25B 27/00* (2013.01); *F01D 15/005* (2013.01); *F25B 1/047* (2013.01); *F01K 25/08* (2013.01)

USPC ..... 62/498

(58) Field of Classification Search

CPC ..... F25B 1/047; F25B 11/02; F25B 1/04; F01D 15/005

USPC ..... 62/401, 498, 116, 402

See application file for complete search history.

(56) References Cited

U.S. PATENT DOCUMENTS

| | | | | | |
|---|---|---|---|---|---|
| 4,086,072 | A * | 4/1978 | Shaw | 62/160 |
| 4,209,998 | A * | 7/1980 | Shaw | 62/324.1 |
| 4,328,684 | A * | 5/1982 | Leo | 62/402 |
| 5,644,928 | A * | 7/1997 | Uda et al. | 62/402 |
| 6,755,039 | B2 | 6/2004 | Tsuboi | |
| 8,006,514 | B2 | 8/2011 | Tsuboi | |
| 2005/0223734 | A1 * | 10/2005 | Smith et al. | 62/402 |
| 2010/0090476 | A1 | 4/2010 | Wada | |

FOREIGN PATENT DOCUMENTS

| | | | | |
|---|---|---|---|---|
| JP | 5818003 | * | 7/1956 | |
| JP | 56012035 | * | 2/1981 | F02G 5/02 |
| JP | 56-43018 | | 4/1981 | |
| JP | 58-18003 U | | 2/1983 | |
| JP | 2005-16742 A | | 1/2005 | |
| JP | 2005016742 | * | 1/2005 | F25B 1/047 |
| JP | 2007-78260 A | | 3/2007 | |
| JP | 2007078260 | * | 3/2007 | F25B 27/00 |
| JP | 2008-274834 A | | 11/2008 | |

OTHER PUBLICATIONS

Japanese Office Action Issued Feb. 12, 2013 in Patent Application No. 2010-230773 (with English translation).

* cited by examiner

*Primary Examiner* — Mohammad M Ali
*Assistant Examiner* — Emmanuel Duke
(74) *Attorney, Agent, or Firm* — Oblon, Spivak, McClelland, Maier & Neustadt, L.L.P.

(57) ABSTRACT

A refrigerator of the present invention includes a Rankine cycle heat engine and a refrigeration cycle heat engine which share a condenser, and drives a compressor of the refrigeration cycle by an expander of the Rankine cycle. A screw expander and a screw compressor are set up within a common casing, and the exhaust side of a rotating shaft of the screw expander is connected to the discharge side of a rotating shaft of the screw compressor. Preferably, an intermediate space in which an exhaust passage of the screw expander and a discharge passage of the screw compressor are merged together and connected to a condenser, and a coupling which connects the rotating shaft of the screw expander to the rotating shaft of the screw compressor is housed is formed within the casing.

4 Claims, 5 Drawing Sheets

REFRIGERATOR

BACKGROUND OF THE INVENTION

1. Field of the Invention

The present invention relates to a refrigerator.

2. Description of the Related Art

A cooling device for vehicle is disclosed in Japanese Patent Application Laid Open No. 56-43018, the cooling device being configured to drive a compressor included in a refrigeration cycle heat engine by a thermal expander.

In this cooling device, a Rankine cycle is constituted so that a heat medium is vaporized by the heat of an engine to drive an expander, and the heat medium expanded by the expander is, after condensed by a radiator, returned to the engine by a pump, and the compressor of the refrigeration cycle is driven by the expander of the Rankine cycle.

In this cooling device, the refrigeration cycle and the Rankine cycle use the same heat medium (refrigerant), and the refrigerant discharged by the compressor of the refrigeration cycle is condensed by the same radiator as in the Rankine cycle, and then supplied to an evaporator. Therefore, the condensation temperature (pressure) of the refrigeration cycle and the condensation temperature (pressure) of the Rankine cycle are equal to each other.

In the above-mentioned related art, the exhaust side of a rotating shaft of the expander is connected to the suction side of a rotating shaft of the compressor. Therefore, it is needed to provide shaft seal devices respectively on the exhaust side of the expander and on the suction side of the compressor.

If leakage occurs in such shaft seal devices of the refrigeration cycle and the Rankine cycle, the heat medium is leaked out of the system to disable the fulfillment of the capability of the cooling device.

SUMMARY OF THE INVENTION

The present invention is thus intended to provide a refrigerator configured to drive a compressor of a refrigeration cycle by an expander of a Rankine cycle, which dispenses with shaft seal.

The refrigerator of the present invention includes: a high-temperature evaporator for vaporizing a heat medium; a screw expander for converting the expansion force of the heat medium vaporized in the high-temperature evaporator to rotational force; a condenser to which the heat medium exhausted from the screw expander is introduced; a circulation pump for supplying at least a portion of the heat medium liquefied in the condenser to the high-temperature evaporator; an expansion valve for decompressing the remaining portion of the heat medium liquefied in the condenser; a low-temperature evaporator for vaporizing the refrigerant decompressed by the expansion valve for heat absorption; a screw compressor for compressing the heat medium vaporized by the low-temperature evaporator; and a casing for housing the screw expander and the screw compressor, wherein the refrigerator is configured to introduce the heat medium discharged from the screw compressor to the condenser while the heat medium merges with the heat medium exhausted from the screw expander, and wherein the exhaust side of a rotating shaft of the screw expander is connected to the discharge side of a rotating shaft of the screw compressor within the casing.

According to this structure, since the exhaust side of the screw expander and the discharge side of the screw compressor communicate with each other, the exhaust pressure of the screw expander and the discharge pressure of the screw compressor becomes the same to prevent the occurrence of flow of heat medium. Thus, the refrigerator of the present invention is inexpensive and has less frequency of failure and high maintenance property with a simplified structure without the need for providing shaft seal devices on the exhaust side of the screw expander and on the discharge side of the screw compressor.

The refrigerator of the present invention may be configured so that an exhaust passage of the screw expander and a discharge passage of the screw compressor are merged together and connected to the condenser, and an intermediate space for housing a coupling which connects the exhaust side of the rotating shaft of the screw expander to the discharge side of the rotating shaft of the screw compressor is formed within the casing.

According to this structure, since the intermediate space for housing the coupling between the rotating shafts of the screw expander and the screw compressor communicates with the exhaust passage of the screw expander and the discharge passage of the screw compressor, there is no flow around the shaft between each of the screw expander and screw compressor, and the intermediate space. Further, the screw expander and the screw compressor can be connected to the condenser by only one connecting pipe.

The refrigerator of the present invention further may include a generator provided within the intermediate space to generate electricity by the rotational force of the screw expander.

According to this structure, when the rotational energy generated by the screw expander is larger than the energy consumed by the screw compressor under reduced refrigeration load, surplus rotational energy can be converted to electric energy by the generator for external consumption or storage.

In the refrigerator of the present invention, the coupling may include a clutch capable of separating the rotating shaft of the screw expander from the rotating shaft of the screw compressor.

According to this structure, when there is no refrigeration load, separating off the screw expander allows the rotational energy generated by the screw expander to be entirely used for power generation.

According to the present invention, since the exhaust side of the rotating shaft of the screw expander of the Rankine cycle is connected to the discharge side of the rotating shaft of the screw compressor of the refrigeration cycle within the casing, a simple and highly reliable refrigerator can be provided without the need for providing shaft seal devices on the exhaust side of the screw expander and on the discharge side of the screw compressor.

DESCRIPTION OF PREFERRED EMBODIMENTS

Figure 1:
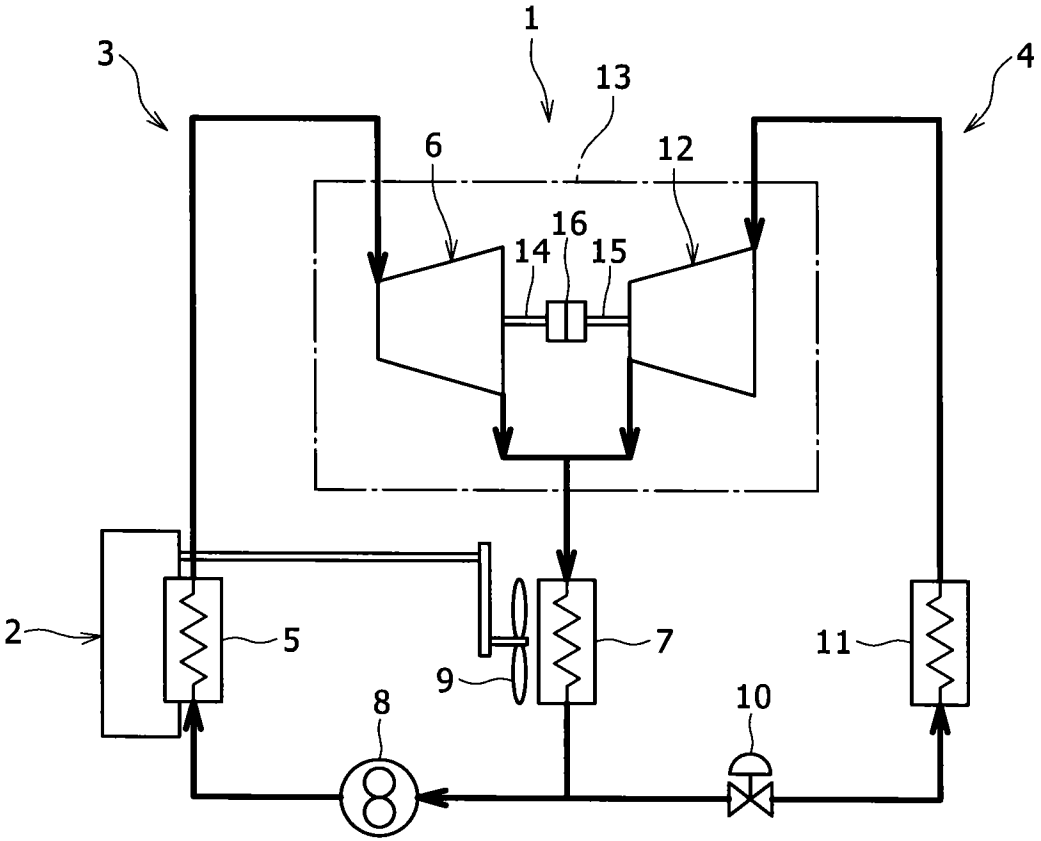
FIG. 1 is a schematic structural view of a refrigerator according to a first embodiment of the present invention.

Preferred embodiments of the present invention will be then described in reference to the drawings. FIG. 1 shows a refrigerator 1 according to the first embodiment of the present invention. The refrigerator 1 is intended to cool an automobile's cabin by recovering and converting thermal energy from an engine 2 of the automobile to power by a Rankine heat engine 3, and driving a refrigeration cycle heat engine 4 by this power.

The Rankine cycle heat engine 3 and the refrigeration cycle heat engine 4 constitute a partially-shared closed system with a heat medium (for example, R245fa) being sealed therein. The Rankine cycle heat engine 3 includes: a high-temperature evaporator 5 integrally formed with a cylinder block of an engine, and vaporizing the heat medium to cool the cylinder block with the vaporization heat of the heat medium; a screw expander 6 supplied with the heat medium evaporated in the high-temperature evaporator 5 and converting the expansion force of the heat medium to rotational force; a condenser 7 for condensing and liquefying the heat medium exhausted from the screw expander 6 by cooling the heat medium; and a circulation pump 8 for resupplying the heat medium liquefied by the condenser 7 to the high-temperature evaporator 5 by pressurizing the heat medium. The condenser 7 is configured to allow the heat medium to be cooled by heat exchange with the outside air supplied by a fan driven by the power of the engine 2.

The refrigeration cycle heat engine 4 shares the condenser 7 with the Rankine cycle heat engine 3, and includes a decompression valve 10 for decompressing the heat medium liquefied in the condenser 7; a low-temperature evaporator 11 for vaporizing the decompressed heat medium to absorb heat from the ambient air; and a screw compressor 12 for resupplying the heat medium vaporized in the evaporator 11 to the condenser by compressing the heat medium.

The screw expander 6 of the Rankine heat engine 3 and the screw compressor 12 of the refrigeration cycle heat engine 4 are set up within a common casing 13. A rotating shaft 14 that is an output of the screw expander 6 and a rotating shaft 15 that is an input of the screw compressor 12 are connected to each other by a coupling 16 inside the casing 13. Accordingly, the screw compressor 12 can be rotationally driven by the screw expander 6.

Figure 2:
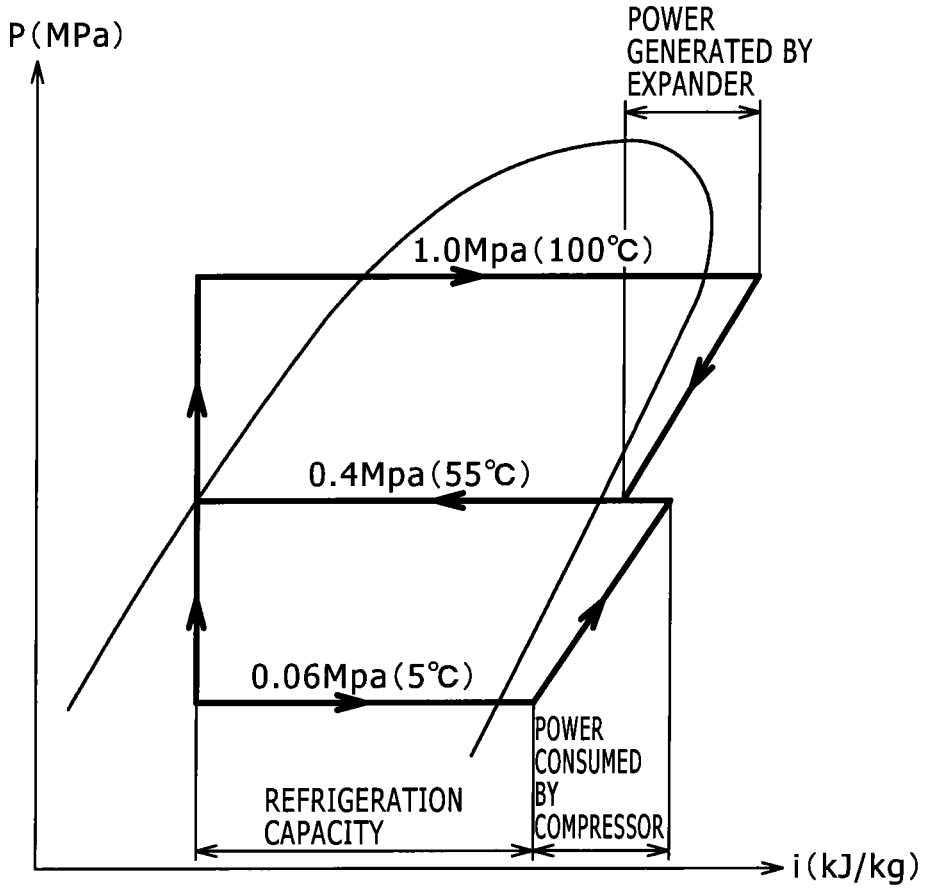
FIG. 2 is a P-i diagram of the refrigerator of FIG. 1.

FIG. 2 shows a P-i diagram of the Rankine cycle heat engine 3 and the refrigeration cycle heat engine 4. As shown in the drawing, the condensation temperature of heat medium in the condenser 7 is 55° C. with pressure of 0.4 MPa, the evaporation temperature of heat medium in the high-temperature evaporator 5 is 100° C. with pressure of 1 MPa, and the evaporation temperature of heat medium in the low-temperature evaporator 11 is 5° C. with pressure of 0.06 MPa.

Figure 3:
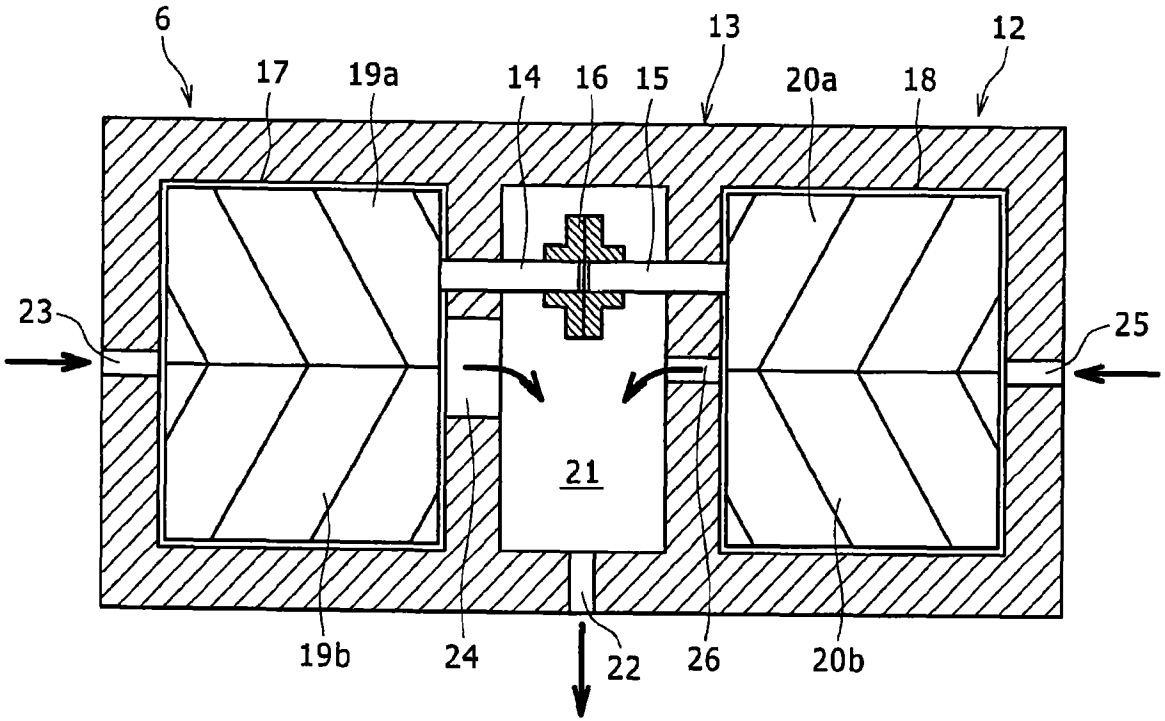
FIG. 3 is a schematic sectional view of a screw expander and a screw compressor in FIG. 1.

FIG. 3 schematically shows the structure of the screw expander 6 and the screw compressor 12. Each of the screw expander 6 and the screw compressor 12 includes a pair of male-female rotors 19*a*, 19*b*; 20*a*, 20*b* within a rotor chamber 17; 18 formed in the common casing 13 respectively. The casing 13 includes an intermediate space 21 defined between the screw expander 6 and the screw compressor 12. The intermediate space 21 is connected to the condenser 7 through a common flow passage 22.

An air supply passage 23 of the screw expander 6 is opened to one end side of the casing 13, and an exhaust passage 24 of the screw expander 6 is opened to the intermediate space 21. A suction passage 25 of the screw compressor 12 is opened to the other end of the casing 13, and a discharge passage 26 of the screw compressor 12 is opened to the intermediate space 21. To attain such a flow direction of heat medium, the turning direction of spiral tooth grooves is reversed between the rotors 19*a*, 19*b* of the screw expander 6 and the rotors 20*a*, 20*b* of the screw compressor 12.

The exhaust side of the rotating shaft 14 of the male rotor 19*a* of the screw expander 6 and the discharge side of the rotating shaft 15 of the male rotor 20*a* of the screw compressor 12 are extended into the intermediate space 21, and connected to each other by the coupling 16.

As shown in FIG. 2, the exhaust pressure of the screw expander 6 and the discharge pressure of the screw compressor 12 are substantially the same pressure of 0.4 MPa. Accordingly, the pressure of the intermediate space 21 also becomes substantially the same as this pressure. Thus, it is not necessary to provide shaft seal devices between the rotor chamber 17 and the intermediate space 21 and between the rotor chamber 18 and the intermediate space 21 respectively.

The air supply side of the screw expander 6 and the suction side of the screw compressor 12 are also constituted to have a sealed structure where the rotating shafts thereof are not exposed to the outside, although not shown in the drawing, whereby the shaft seal devices are not needed.

In this way, by constituting the screw expander 6 and the screw compressor 12 within the common casing 13 so that the exhaust side of the screw expander 6 and the discharge side of the screw compressor 12 are opposed to each other, the screw expander 6 and the screw compressor 12 do not need components for sealing the rotating shafts, and high reliability and easiness to maintenance can be secured at low cost.

Figure 4:
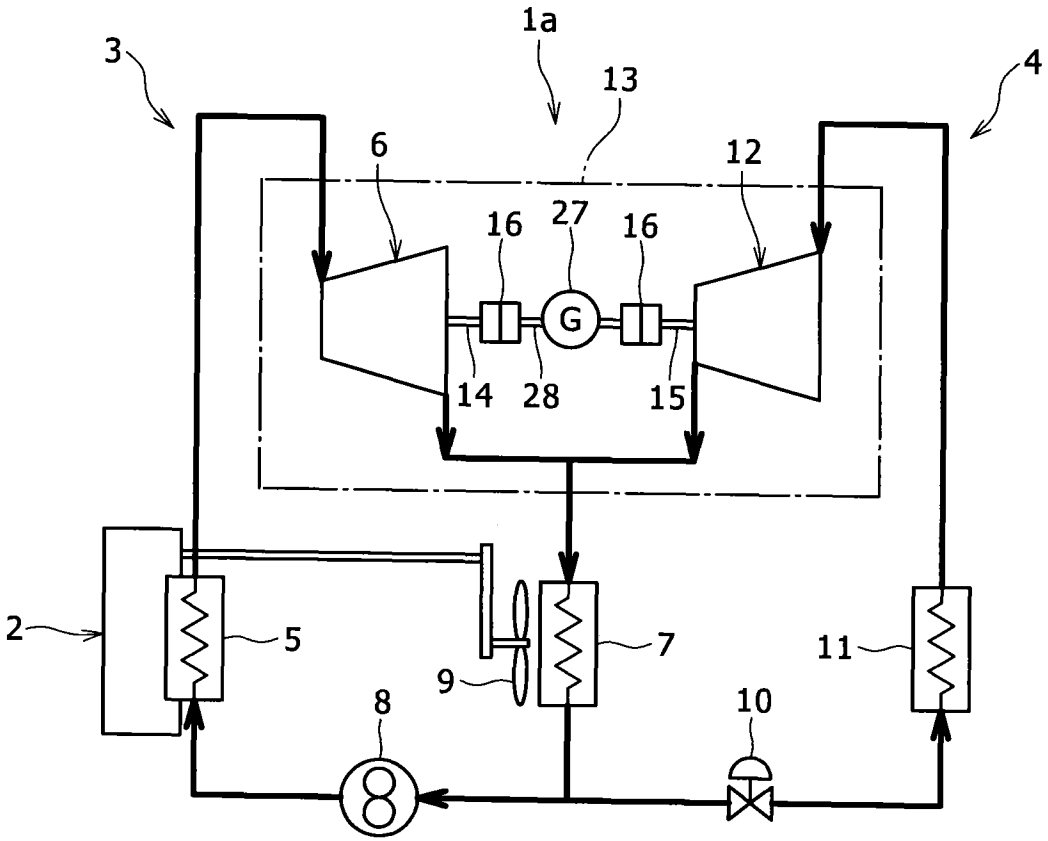
FIG. 4 is a schematic structural view of a refrigerator according to a second embodiment of the present invention.

FIG. 4 shows a refrigerator 1*a* according to a second embodiment of the present invention. In the following embodiments, the same reference number is assigned to the same component as described above to omit duplicate description. In the refrigerator la of this embodiment, a generator 27 is disposed within a casing 13 (intermediate space 21). A rotating shaft 28 of the generator 27 is connected respectively to the rotating shaft 14 of the screw expander 6 and the rotating shaft 15 of the screw compressor 12 by couplings 16.

The power generated by the generator 27 is drawn out of the casing 13 by a cable not shown, and stored in a battery of an automobile. Of course, this power can be directly consumed by other electric devices without through the battery.

This embodiment is applied when the rotating power which can be generated in the screw expander 6 of the Rankine cycle heat engine 3 is larger than the rotational power consumed by the screw compressor 12 of the refrigeration cycle heat engine 4, or when the output of the engine 2 is large and the thermal energy which can be recovered in cooling of the engine 2 is large. And the surplus rotational power is converted to electric energy by the generator 27 so as to be usable.

Figure 5:
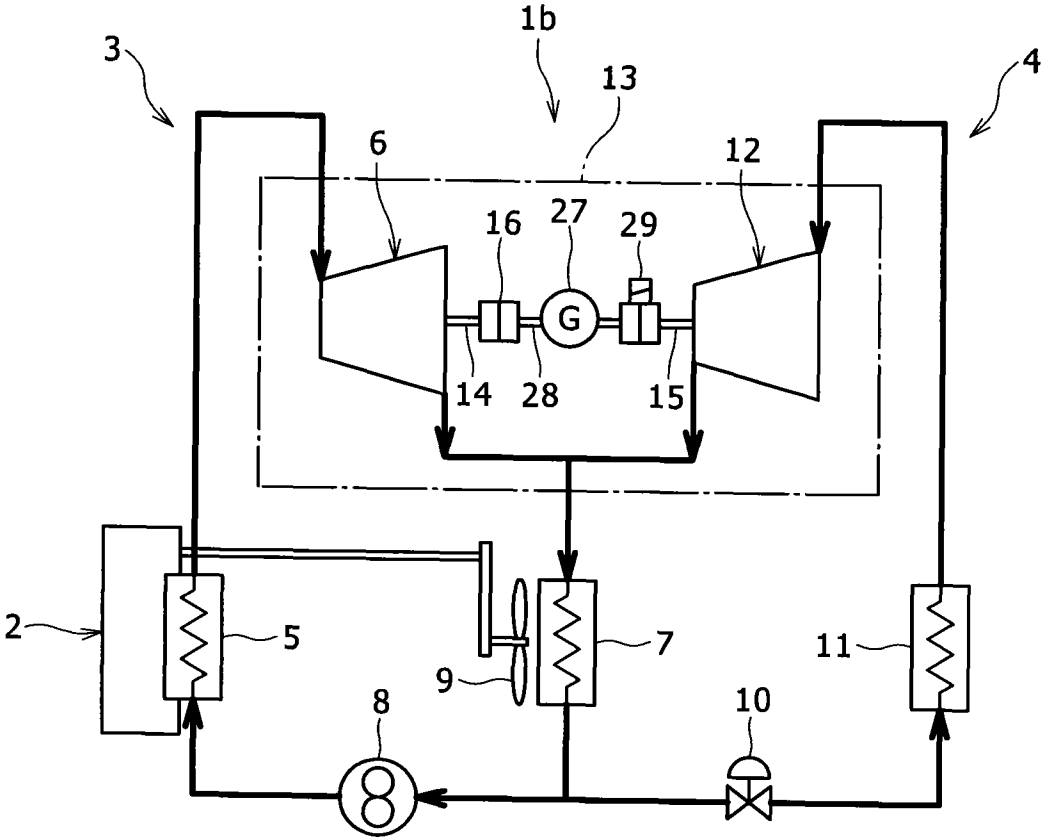
FIG. 5 is a schematic structural view of a refrigerator according to a third embodiment of the present invention.

Further, FIG. 5 shows a refrigerator 1*b* according to a third embodiment of the present invention. In this refrigerator 1*b*, the coupling which connects the rotating shaft 28 of the generator 27 to the rotating shaft 15 of the screw compressor 12 is composed of an electromagnetic clutch 29.

In this embodiment, the rotating shaft 15 of the screw compressor 12 is separated from the rotating shaft 14 of the screw expander 6 by throwing out the electromagnetic clutch 29, exhaust heat of the engine 2 is recovered by the Rankine cycle heat engine 3 with the refrigeration cycle heat engine 4 being halted, whereby the generator 27 can be driven to generate power. Thus, in this embodiment, when the cooling load is low as during winter season, the exhaust heat of the engine 2 can be recovered and effectively used.

In the present invention, the coupling 16 may be composed of another transmission mechanism such as a gear mechanism or chain-sprocket. Further, the generator 27 can be connected in parallel to the screw compressor 12 by selecting a proper transmission mechanism, and speed change may be performed as needed.

What is claimed is:

1. A refrigerator comprising:

a high-temperature evaporator thermally communicating with a high temperature heat source for vaporizing a heat medium;

a screw expander comprising male and female rotors for converting the expansion force of the heat medium vaporized in said high-temperature evaporator to rotational force;

a condenser to which the heat medium exhausted from said screw expander is introduced;

a circulation pump for supplying at least a portion of the heat medium liquefied in said condenser to said high-temperature evaporator;

an expansion valve for decompressing the remaining portion of the heat medium liquefied in said condenser;

a low-temperature evaporator thermally communicating with a low temperature heat source having a temperature lower than a temperature of the high temperature heat source, for vaporizing the heat medium decompressed by said expansion valve for heat absorption;

a screw compressor comprising male and female rotors for compressing the heat medium vaporized by said low-temperature evaporator; and a casing for housing said screw expander and said screw compressor, wherein said casing comprises a screw expander rotor chamber housing said male and female rotors of the screw expander, and a screw compressor rotor chamber housing said male and female rotors of the screw compressor, and wherein said screw expander and said screw compressor are arranged such that an exhaust side of the rotating shaft of said screw expander and a discharge side of the rotating shaft of said screw compressor face an intermediate space in said casing, the intermediate space being provided between said screw expander and said screw compressor, and an exhaust passage of said screw expander and a discharge passage of said screw compressor are merged together in the intermediate space of said casing, wherein the refrigerator is configured to introduce the heat medium discharged from said screw compressor to said condenser while the heat medium merges with the heat medium exhausted from said screw expander, and wherein the exhaust side of the rotating shaft of said screw expander is connected within said intermediate space of said casing to the discharge side of the rotating shaft of said screw compressor.

2. The refrigerator according to claim 1, wherein the merged exhaust passage of said screw expander and the discharge passage of said screw compressor are connected to said condenser, and wherein the intermediate space houses a coupling which connects the exhaust side of said rotating shaft of said screw expander to the discharge side of said rotating shaft of said screw compressor.

3. The refrigerator according to claim 2, wherein a generator is provided within said intermediate space to generate electricity by the rotational force of said screw expander.

4. The refrigerator according to claim 3, wherein said coupling includes a clutch capable of separating said rotating shaft of said screw expander from said rotating shaft of said screw compressor.

* * * * *